United States Patent [19]

Kokubo et al.

[11] 4,287,900

[45] Sep. 8, 1981

[54] COIN DISCHARGE MACHINE

[75] Inventors: Eiichi Kokubo; Takatoshi Sugai, both of Tokyo, Japan

[73] Assignee: Laurel Bank Machine Co., Ltd., Tokyo, Japan

[21] Appl. No.: 131,908

[22] Filed: Mar. 20, 1980

[30] Foreign Application Priority Data

Mar. 22, 1979 [JP] Japan ..... 54-37430[U]

[51] Int. Cl.[3] ..... G07D 9/04

[52] U.S. Cl. ..... 133/4 A; 133/8 B

[58] Field of Search ..... 194/99, 102, 97 A, 97 R; 133/4 A, 8 B; 194/9, 10

[56] References Cited

U.S. PATENT DOCUMENTS 3,191,739 6/1965 White, Jr. ..... 194/9 R 4,226,253 10/1980 Kokubo et al. ..... 133/8 B

*Primary Examiner*—Stanley H. Tollberg

*Attorney, Agent, or Firm*—Fleit & Jacobson

[57] ABSTRACT

A coin discharge machine wherein a plurality of cartridges, each accommodating coins of a given species, are provided and coins accumulated in at least one selected cartridge are pushed out, one at a time, from the lowermost by selected pair of rod pushers into a coin dropping outlet while each of coins being pushed in caused to be engaged with a counting arm which actuates a microswitch for counting. A comparator is provided for comparing data indicating the selected pair of rod pushers and data indicating selectively actuated microswitches. When both of data are not coincident, the coin discharge machine is stopped.

2 Claims, 6 Drawing Figures

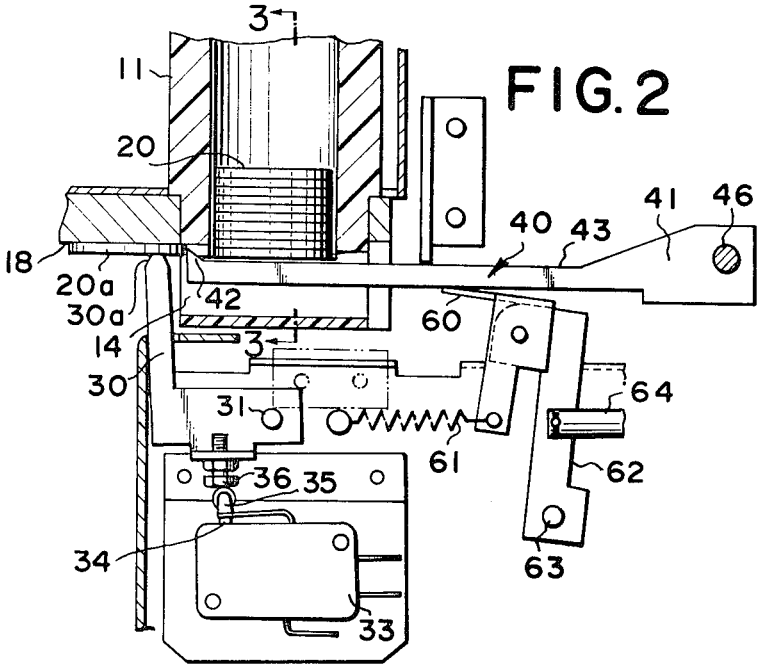
FIG. 2
FIG. 3
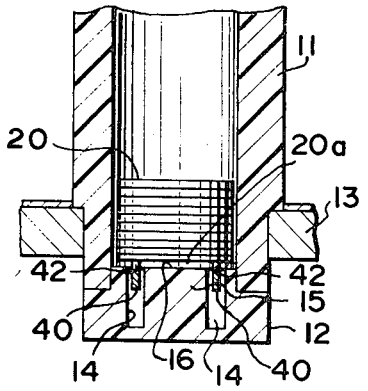
FIG. 5
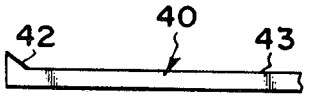
FIG. 4
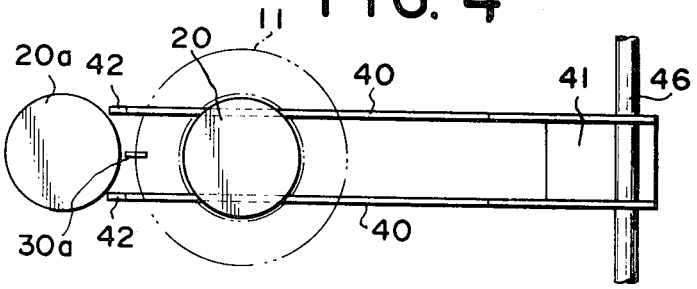

COIN DISCHARGE MACHINE

BACKGROUND OF THE INVENTION

This invention relates to a coin discharge machine.

There has been known a coin discharge machine wherein coins accumulated in at least one cartridge are pushed out from the cartridge, one at a time, from the lowermost by at least one selected pair of rod pushers into a coin dropping outlet, each selected pair of rod pushers pushes the lowermost coin of coins accumulated in the cartridge at the side portions of the periphery thereof beyond an edge of a count arm for counting which is disposed to be engaged with the center portion of the periphery of the coin, each rod pusher is formed at the end thereof with a projection which is engaged with and pushes the lowermost coin, and the residual stacked coins are supported by an extension of a support plate for preventing the residual stacked coins from resting on the pair of rod pushers in the course of operation.

The conventional machine ensures, to some extent, that coins accumulated in one or more selected cartridges are positively discharged one at a time and introduced into a coin dropping outlet. However, there would be a possibility that coins are discharged none or two at a time for the following reasons, that is, when the operation of the selenoids for bringing the pair of rod pushers is not proper or when the configuration of the rod pushers are altered or the operation of the rod pushers is not proper. Therefore, it is necessary to confirm whether the discharge of coins are corretly carried out.

SUMMARY OF THE INVENTION

It is, therefore, an object of the invention to provide a novel coin discharge machine which confirms whether coins accumulated in one or more selected cartridges are discharged one at a time and introduced into a coin dropping outlet.

It is another object of the invention to provide a coin discharge machine of the above type wherein when coins are not discharged one at a time, the machine is caused to be stopped.

According to the invention, there is provided a coin discharge machine wherein coins accumulated in at least one cartridge are pushed out from the cartridge, one at a time, from the lowermost by at least one selected pair of rod pushers into a coin dropping outlet, which comprises a plurality of select arm driving solenoids selectively actuated in accordance with kinds of coins to be discharged, to bring the selected pair of rod pushers to an upper position so that each selected pair of rod pushers pushes the lowermost coin of coins accumulated in the cartridge, a plurality of microswitches selectively actuated by the lowermost coins pushed by the selected pair of rod pushers, and a comparator for receiving and comparating data indicating the selectively actuated solenoids and data indicating the selectively actuated microswitches, whereby, when both of data are not coincedent, the coin discharge machine is stopped.

DETAILED DESCRIPTION OF THE PREFERRED EMBODIMENT OF THE INVENTION

Figure 1:
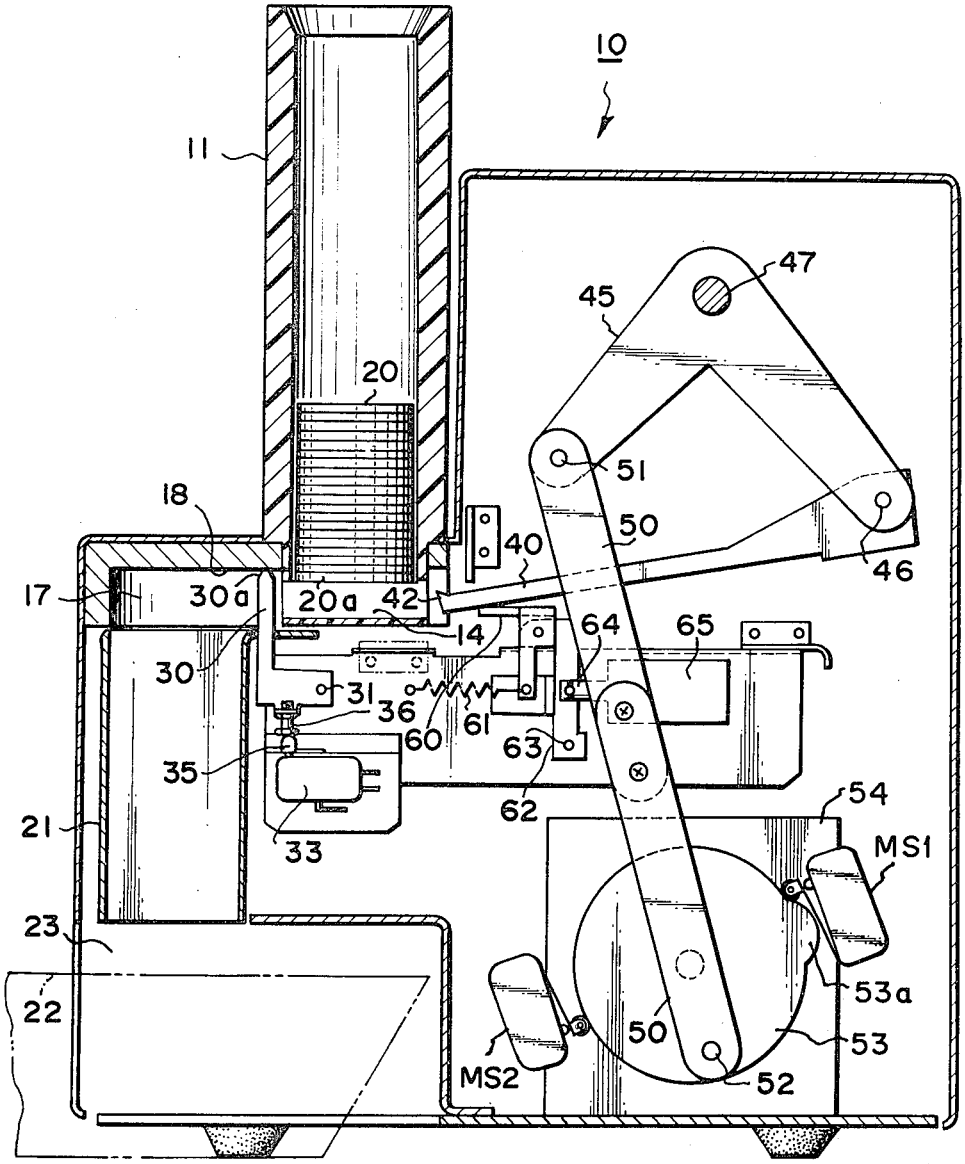
Figure 6:
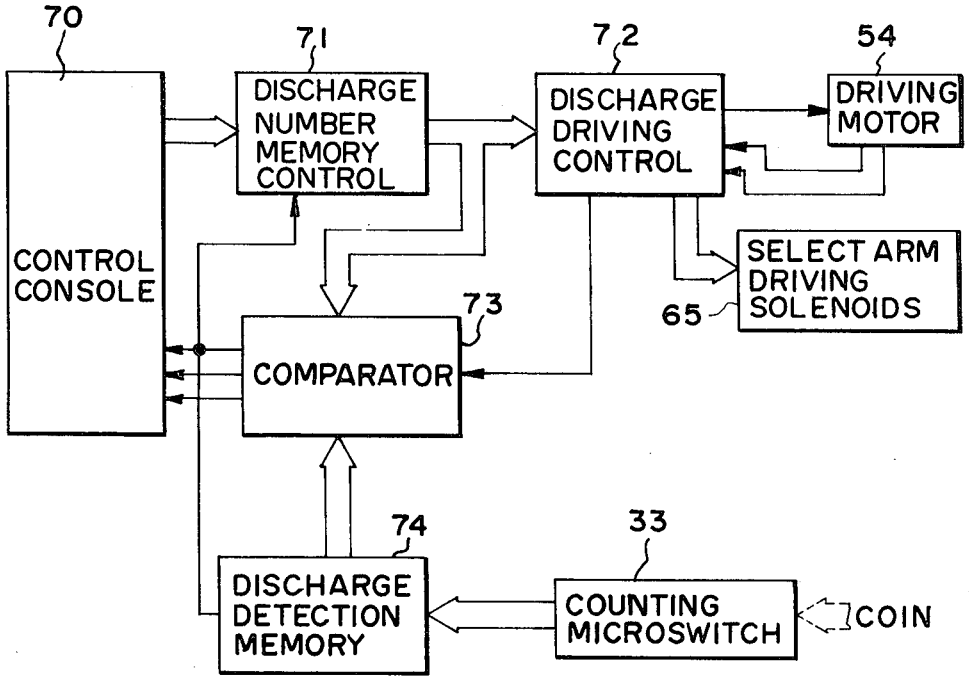

The invention will be now explained with reference to the accompanying drawings in which:

FIG. 1 is a cross-sectional view showing a coin discharge machine according to the present invention, FIG. 2 is an enlarged cross-sectional view of the main portion of FIG. 1, FIG. 3 is a cross-sectional view taken along lines 3—3 of FIG. 2, FIG. 4 is a plan view of a pair of rod pushers used in the coin discharge machine according to the invention, FIG. 5 is a side view of one of the pair of rod pushers, and FIG. 6 is a block diagram showing the operation of the discharge machine.

Referring now to the drawings, FIG. 1 shows a cross-sectional view of a coin discharge machine 10. The machine 10 is provided with a plurality of cartridges 11 for accommodating coins of various species so that each cartridge accommodates coins of a different species. For clarity of illustration, one of the cartridges and members associated therewith will be explained. The cartridge 11 of a hollow cylindrical form is joined at the bottom end thereof to a circular support plate 12 and is supported on the frame of the machine as shown in FIG. 3. The support plate 12 is formed with a reduced circular extension 15 upwardly coaxially of the support plate body. The support plate is also formed with two parallel grooves 12 which extend through the opposite sides thereof in a direction toward a coin dropping outlet 17 as shown in FIGS. 1 and 3. Coins to be pushed are accumulated or stacked in the cartridge 11 and the lowermost coin **20*a* is supported on the upper surface 16 of the extension 15. The lowermost coin 20*a* is pushed by a pair of rod pushers 40, which will be explained hereinafter in more detail, toward the coin dropping outlet 17 between the lower surface 18 of the frame and an edge 30*a* of a count arm 30 from the cartridge. The coin thus pushed and then introduced into the coin dropping outlet 17 falls down a discharge cylinder 21 into a carton 22 disposed in a coin receiving section 23**.

The count arm 30 of L-shaped form is disposed just behind the cartridge 11 as is pivotably mounted at 31. The count arm 30 is supported on a microswitch 33 mounted on the frame of the machine so that the edge **30*a* of the count arm 30 is engaged with the lower surface 18 through adjustment of a bolt 36 riding on an actuator 35 of the microswitch 33 which serves to close contacts 34, only one of which is shown in FIG. 2. The edge of the count arm is disposed so that the coin being pushed by the pair of rod pushers is forced to ride on the edge of the count arm at the longitudinally center line or diametrical line of the coin. Therefore, when the lowermost coin 20*a* is pushed and forced to ride on the edge of the count arm and thereby to move through between the lower surface 18 of the frame 13 and the edge 30*a* of the count arm 30, the count arm is rotated in an anti-clockwise direction about a pivot 31 and thus the bolt 36 depresses the actuater 35 of the microswitch 33 to close contacts 34**, giving a count.

The pair of rod pushers 40 is disposed adjacent the support plate 12 and are integrally formed with the base 41 of the rod pushers so that two rod pushers are parallel to each other. Each rod pusher is provided at the end thereof with a triangle projection 42 on the upper surface 43 of the rod pusher. The base 41 is pivotably mounted on one end of a bell crank 45 at a pivot pin 46. The bell crank 45 is pivotably mounted on the frame of the machine at a pivot 47 and the other end thereof is pivotably mounted at a pivot pin 51 on an interlocking rod 50 at one end thereof, which is in turn pivotably mounted at the other end thereof on a pin 52 mounted on the peripheral portion of a rotary member 53 of a motor 54. The rotary member 54 is provided at its circumferential surface with a projection 53*a* which is adapted to actuate microswitches MS1 and MS2 to switch on, alternately, which are disposed adjacent the circumferential surface of the rotary member and are spaced away from each other at angles of 180 degrees. The rod pusher is thus moved through the groove 14 toward and away from the coin dropping outlet when the motor 54 is actuated to cause the rotary member to be rotated. In this instance, in non-operation condition or when a solenoid 65 is not actuated, which will later be explained in more detail, although the rod pusher 41 is moved toward and away from the coin dropping outlet 17, the projection 42 of the rod pusher 40 passes below the lowermost coin 20*a* and is not engaged with the same.

A select arm 60 is disposed under the pair of rod pushers 40 in engagement therewith and is biased by a tension spring 61 in an anti-clockwise direction. The select arm 60 is rigidly connected to a select bar 62 which is pivotably mounted at a pivot 63 and is connected to an actuator 64 of a solenoid 65. When at least one solenoid 65 is selectively actuated by on-signal of the microswitch MS1, the actuator 64 of the selected solenoid 65 causes the select bar 62 and, therefore, the select arm 60 to rotate in a clockwise direction against the action of the tension spring 61 and thereby to bring the pair of rod pushers 40 to an upper position or an operation position. In operation position, the projections 42 of the rod pushers 40 are engaged with the lowermost coin 20*a* at the side portions of the periphery thereof while the upper surfaces 43 of the rod pushers 40 are flush with or below the surface 16 of the extension 15. Therefore, the stacked coins do not put a load on the upper surfaces 43 of the rod pushers 40 since the lower surface of the lowermost coin is not supported on the upper surfaces 43 of the rod pushers but on the surface 16 of the extension 15.

In the forward stroke of the rod pushers, the selected rod pushers are brought up to the upper position or to the operation position by energizing the selected solenoid 65 and, therefore, are caused to be engaged with the lowermost coin 20*a* accumulated in the cartridge 11. The lowermost coin 20*a* is then pushed out of the cartridge into the coin dropping outlet 17. In this instance, the rod pushers can push the coin beyond the edge 30*a* of the count arm 30 and can positively introduce the coin into the coin dropping outlet 17 in which the coin thus introduced drops down the discharge cylinder 21 into the carton 22 since the edge 30*a* of the count arm 30 does not disrupt the rod pushers 40.

In the backward stroke of the rod pushers, when the rod pushers come to the leftmost side, the microswitch MS2 is adapted to be actuated by the projection 53*a* of the rotary member 53 to deenergize the solenoid 65. Then, the selected rod pushers which has been in the upper position or to the operation position are brought down to the lower position or to the non-operation position. Then, all rod pushers are retracted to the initial position.

In operation, as shown in FIG. 1, a number of coins 20 are introduced into the cartridges 11. The lowermost coins 20*a* are supported on the surfaces 16 of the extensions 15 of the support plates 12 and, therefore, the weight of the coins is loaded on the surfaces 16. As shown in FIG. 1, while the pairs of rod pushers 40 are moved from the position shown in FIG. 1 in which the pairs of the rod pushers 40 are spaced away from the support plates toward the grooves 41 of the support plates, one or more of the solenoids 65 are selectively actuated by the on-signal of the microswitch MS1. In this forward stroke of rod pushers, the select arm 60 thus selected brings the pair of rod pushers up to an operation position. The rod pushers into the grooves 14 and only the selected one or more pairs of rod pushers become engaged with the lowermost coins 20*a* at the side portions thereof by the projections 42 and push the lowermost coins 20*a* out of the cartridge while the non-selected rod pushers are not engaged with the coins. Each coin thus pushed is forced to ride on the edge 30*a* of the count arm 30 and then passes between the lower surface 18 and the edge 30*a*. Consequently, the count arm is rotated to actuate the actuator 35 of the microswitch 33 to give a count. The coin is then further pushed beyond the edge 30*a* of the count arm 30 into the coin dropping outlet 17. Thus, the coin introduced into the coin dropping outlet 17 drops down the discharge cylinder 21 into the carton 22 disposed within the coin receiving section 23.

After the rod pushers finish pushing the coin, the selected rod pushers are lowered into a non-operation position by deenergizing the solenoid 65 through the on-signal of the microswitch MS2 and are withdrawn in the backward stroke thereof. Then, the rod pushers are ready for the next cycle.

In this instance, when the rod pushers 40 push the lowermost coin out of the cartridge 11, the coin next to the lowermost coin drops onto the surface 16 of the extension 15. Therefore, the weight of the coins accumulated in the cartridge put no load on the rod pushers and do not cause the rod pushers to be lowered. Therefore, the rod pushers can continue to push the lowermost coin until the lowermost coin is fully introduced into the coin dropping outlet.

Referring now to FIG. 6 showing a block diagram for operation of the discharge machine, a control console 70 transmits data indicating the number of coins to be discharged or the amount of money for each species of coins to a discharge number memory control 71. The discharge number memory control 71 has a group of counters, each storing the number of coins to be discharged for each species of coins and a memory in which a flag is set from judgment on contents stored in each counter for each species of coins. The flag bits stored in the memory are transmitted to a discharge driving control 72 as well as a comparator 73. The discharge driving control 72 comprises gate circuit which transmits flag bits from the memory to select arm driving solenoids 65 by the on-signal of the microswitch MS1 driven by the motor 65 and, thereby selectively energizing the solenoids 65 in accordance with the contents of the flag bits. Thus, the kinds of coins are selectively counted by the microswitches 33 and discharged into the carton 22. The contents counted by the microswitch 33 are stored in a discharge detection memory 74 and transmitted to the comparator 73. In the comparator 73, the flag bits which has been transmitted from the memory of the discharge number memory control 71 are compared with the contents transmitted from the discharge detection memory 74. If the flags bits and the contents are coincedent, a coincedence signal is issued from the comparator and transmitted to the control console 70, the discharge number memory control 71 and the discharge detection memory 74. Consequently, in the discharge number memory control 71 the contents corresponding to the number of coins to be discharged stored in the counters of the discharge number memory control 71 are reduced by the contents corresponding to the flag bits or the number of coins which has been discharged for each species of coins, and the flag bits set in the memory are cleared. Simultaneously, the contents of discharge detection memory 74 are also cleared. In addition, the control console 70 indicates a next cycle to the discharge number memory control 71. If the flag bits and the contents are not coincedent when compared in the comparator 73, the comparator 73 indicates the control console 70 to stop the discharge operation of the coin discharge machine, and thereby stopping the same.

What is claimed is:

1. A coin discharge machine wherein coins (20) accumulated in at least one cartridge (11) are pushed out from the cartridge, one at a time, from the lowermost by at least one selected pair of rod pushers (40) into a coin dropping outlet (17), which comprises a plurality of select arm driving solenoids (65) selectively actuated in accordance with kinds of coins to be discharged, to bring the selected pair of rod pushers (40) to an upper position so that each selected pair of rod pushers (40) pushes the lowermost coin **(20*a*) of coins (20) accumulated in the cartridge (11), a plurality of microswitches (33) selectively actuated by the lowermost coins (20*a*) pushed by the selected pair of rod pushers (40), and a comparator (73) for receiving and comparating data indicating the selectively actuated solenoids (65) and data indicating the selectively actuated microswitches (33)**, whereby, when both of data are not coincedent, the coin discharge machine is stopped.

2. A machine as set forth in claim 1 wherein the select arm driving solenoids are selectively actuated, in accordance with data indicating the kinds of coins to be discharged, by on-signal of the microswitch MS1 driving by a motor 54.

* * * * *